United States Patent [19]

Watanabe et al.

[11] Patent Number: 4,849,282

[45] Date of Patent: Jul. 18, 1989

[54] PRESTRESSING STEEL MATERIAL

[75] Inventors: Kanji Watanabe; Mikio Mizoe, both of Hyogo, Japan

[73] Assignee: Sumitomo Electric, Osaka, Japan

[21] Appl. No.: 61,363

[22] Filed: Jun. 15, 1987

Related U.S. Application Data

[62] Division of Ser. No. 849,334, Apr. 8, 1986.

[30] Foreign Application Priority Data

Apr. 8, 1985 [JP] Japan ..... 60-74985
Apr. 8, 1985 [JP] Japan ..... 60-74986

[51] Int. Cl.[4] ..... B28B 9/04; E04C 5/01

[52] U.S. Cl. ..... 428/321.5; 52/223 L; 52/230; 52/232; 52/722; 57/217; 57/223; 264/228; 264/229; 428/327; 428/334; 428/364; 428/372

[58] Field of Search ..... 428/327, 328, 402.2, 428/402.21; 264/228, 229; 156/79; 52/230, 232, 722, 223 L; 57/217, 223

[56] References Cited

U.S. PATENT DOCUMENTS

| | | | |
|---|---|---|---|
| 3,111,569 | 11/1963 | Rubenstein | 219/19 |
| 3,646,748 | 3/1972 | Lang | 57/149 |
| 3,657,379 | 4/1972 | Hilbehinr et al. | 428/402.22 |
| 3,922,437 | 11/1975 | Kitta et al. | 428/383 |
| 4,404,828 | 10/1983 | Blachford | 428/402.2 |
| 4,536,524 | 8/1985 | Hart et al. | 428/402.21 |
| 4,643,929 | 2/1987 | Watanabe | 428/36 |
| 4,661,387 | 4/1987 | Watanabe | 428/36 |

FOREIGN PATENT DOCUMENTS

| | | |
|---|---|---|
| 0146126 | 6/1985 | European Pat. Off. . |
| 0129976 | 7/1985 | European Pat. Off. . |
| 2059452 | 6/1971 | France . |
| 2378894 | 12/1977 | France . |
| 7901825 | 2/1980 | France . |
| 894946 | 4/1962 | United Kingdom . |

*Primary Examiner*—George F. Lesmes
*Assistant Examiner*—James B. Monroe
*Attorney, Agent, or Firm*—Sughrue, Mion, Zinn, Macpeak & Seas

[57] ABSTRACT

An elongated prestressing steel material for use in the fabrication of prestressed concrete comprises a steel member and an outer coat of many microcapsules each containing a flowable material in its interior.

17 Claims, 4 Drawing Sheets

PRESTRESSING STEEL MATERIAL

This is a division of application Ser. No. 849,334 filed Apr. 8, 1986.

BACKGROUND OF THE INVENTION

The present invention relates to a prestressing steel material for use in the fabrication of prestressed concrete by post-tensioning, and particularly to a prestressing steel material having a coating layer of microcapsules.

Concrete is preloaded with compressive stresses by applying tension to prestressing steel materials. There are two general methods of prestressing, namely pretensioning which is conducted before the concrete sets and hardens, and post-tensioning performed after the setting and hardening of the concrete.

Post-tensioning may be performed in two different manners. In one method, concrete is bonded to the prestressing steel material by means of mortar; in the other method generally referred to as the unbonding process, the prestressing steel material is positioned close to the concrete but separated therefrom by an intervening flowable material such as grease or asphalt.

The first bonding method is typically implemented as illustrated in FIG. 1: prior to pouring concrete, a sheath made of a thin iron plate is buried in the area where the prestressing steel material is to be positioned, and the prestressing steel material is inserted into the space of the sheath before or after the concrete sets, and the concrete then is prestressed by applying tension to the prestressing steel material. Thereafter, any space left in the sheath is filled with a grout such as mortar which will solidify to provide an integral and strong combination of the concrete and the prestressing steel material.

Grout such as mortar may be effective in protecting the prestressing steel material from corrosion but its primary function is to increase the durability of the member so that it may have sufficient rigidity and strength against bending and shear stresses.

Structural designs used to prevent direct contact between the prestressing steel material and the surrounding prestressed concrete are illustred in FIGS. 2 and 3. The design shown in FIG. 2 can be used for the prestressing steel material having a steel member of any form of a wire, bar or strand. A steel member 1 having a grease coating 7 is sheathed with a PE (polyethylene) tube 8. When the steel member 1 with the PE tube 8 is placed within a concrete section 6, the lubricating effect of the intermediate grease coating 7 reduces the coefficient of friction between the steel member and concrete to as low as between 0.002 and 0.005 $m^{-1}$. Because of this low coefficient of friction, the design in FIG. 2 provides great ease in post-tensioning a long steel cable in concrete. However, if the prestressing steel material is of short length, the need for preventing grease leakage from either end of the PE tube presents great difficulty in fabricating and handling the prestressing steel material. Furthermore, steel members having screws or heads at ends are difficult to produce in a continuous fashion.

The steel member 1 shown in FIG. 3, which is encapsulated in asphalt 9, has a lightly greater coefficient of friction than that of the structure shown in FIG. 2. However, this design is extensively used with relatively short prestressing steel materials since it is simple in construction, is lead-free, and provides ease in unbonding the prestressing steel material from the concrete, even if the steel member has screws or heads at end portions.

One problem with the design in FIG. 3 is that the presence of the asphalt (or its equivalent such as a paint) may adversely affect the working environment due to the inclusion therein of a volatile organic solvent. Moreover, the floor may be fouled by the splashing of the asphalt or paint. As another problem, great difficulty is involved in handling the coated prestressing steel material during drying after the coating or positioning within a framework, and separation of the asphalt coating can easily occur unless utmost care is taken in ensuring the desired coating thickness.

Further, according to the construction as shown in FIG. 2, although the sufficient corrosion resistance can be obtained by simply tensioning the prestressing steel material after the setting and hardening of the concrete without additional operations such as grouting, the member is unable to exhibit as high a durability as can be attained by grouting, since the prestressing steel material is fixed merely to the ends of the concrete section.

It is therefore more common to adopt the bonding process, rather than unbonding, if design considerations require sufficient rigidity and strength against bonding and shear stresses. The problem however is that the bonding process including the grouting step involves cumbersome procedures as compared with the unbonding process. For example, the bonding process inevitably involves not only the procurement of the sheath, grout, and fittings to be installed at the ends of the concrete section in preparation for grout injection, but also inventory management and installation of these materials, as well as operations and management of grout injection, and an extension of the working time.

Compared with the bonding method, the unbonding process involving no grouting step is very simple to peform and this simplicity in operation makes the unbonding process most attractive from a practical viewpoint. An advantage resulting from this feature is the small number of factors that might contribute to degraded reliability for the resultant construction.

SUMMARY OF THE INVENTION

The primary object, therefore, of the present invention is to provide a prestressing steel material for use in the fabrication of prestressed concrete by eliminating the aforementioned problems of the prior art.

Another object of the present invention is to provide a prestressing steel material for use in the fabrication of prestressed concrete which has a coat that is dry and nonflowable so that the coat will not stick to associated devices or operator's clothes during transportation and handling of the coated prestressing steel material while retaining its soundness as a coat.

Still another object of the present invention is to provide a prestressing steel material for use in the fabrication of prestressed concrete by post-tensioning while keeping the most of the operational simplicity of the unbonding process without sacrificing the advantages offered by the bonding process, i.e., the capability to impart sufficient improvements in flexural rigidity, shear strength and the like.

The above objects are accomplished by first preparing microcapsules containing a flowable material and then applying such microcapsules to or installing them on the outer surface of a steel member.

DETAILED DESCRIPTION OF THE INVENTION

The present invention will now be described with reference to the accompanying drawings.

Figure 1:
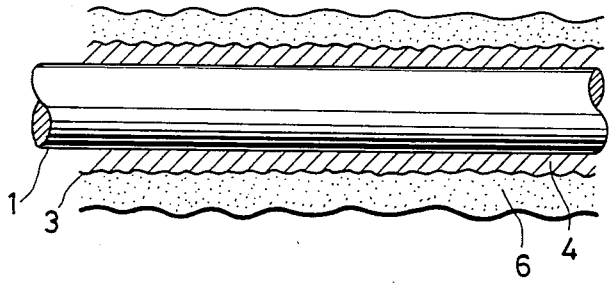
FIG. 1 is a view showing a conventional structure of a prestressing steel material for use in the fabrication of prestressed concrete by post-tensioning in accordance with the bonding process.
Figure 2:
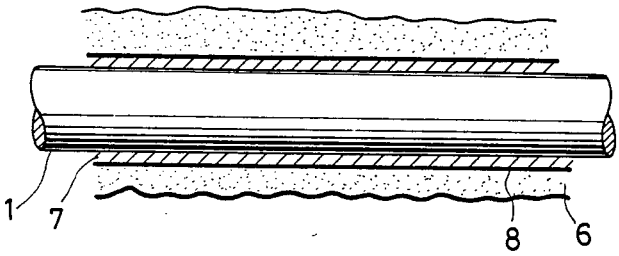
FIGS. 2 and 3 are views showing two conventional prestressing steel materials for use in the fabrication of prestressed concrete by post-tensioning in accordance with the bonding process.
Figure 3:
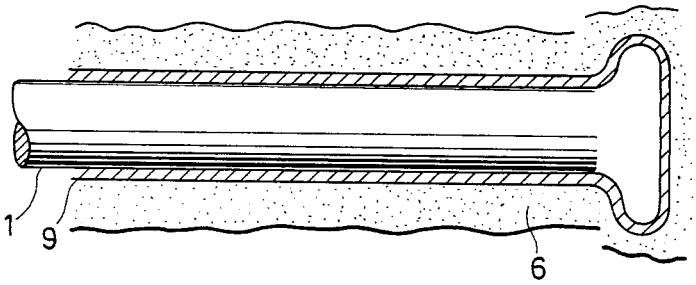
Figure 4:
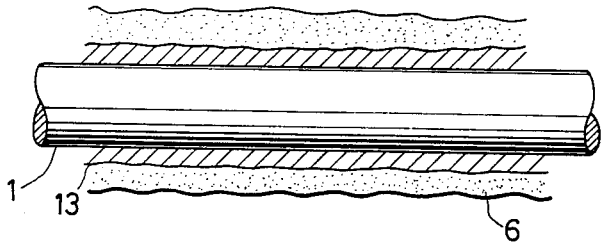
FIG. 4 is a longitudinal sectional view showing the structure of a coated prestressing steel material in accordance with the present invention, where a steel member is a single wire.
Figure 5:
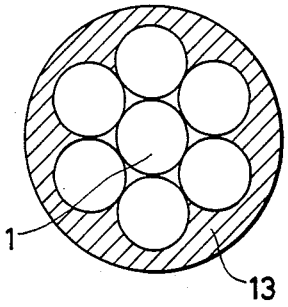
FIG. 5 is a cross sectional view showing the structure of a coated prestressing steel material in accordance with the present invention, where the steel member is composed of stranded wires.

In accordance with the present invention, as shown in FIGS. 4 or 5, microcapsules 13 are employed as a coating material that exhibits the desired "unbonding" property when stress is applied to the coated prestressing steel material placed in concrete. The microcapsules are made by confining in a resin or gelatin wall any flowable material or compound such as water, an aqueous solution, oil, grease or asphalt.

The microcapsules used in the present invention are described, for example, in Japanese Patent Application Laid-Open Nos. 161833/81, 4527/86 or 11138/86. The diameter of a microcapsule is preferably 100–300 μm. If the diameter is less than 100 μm, it is difficult to form the microcapsule. If the diameter is more than 300 μm, the strength of the microcapsule is low. The so prepared microcapsules may be applied to the outer surface of the steel member with the aid of a water-soluble adhesive agent such as PVA (Polyvinyl alcohol), carboxymethylcellulose, or hydroxyethycellulose. After the solution of the adhesive agent is coated on the outer surface of the steel member, the microcapsules are applied to the surface. Alternatively, a coat of the microcapsules may be formed by mixing microcapsules with powders of polyolefin system hydrocarbon such as paraffin or low molecular weight polyethylene, melting the low-melting material of the mixture by heat, and then cooling and solidifying the mixture.

When the water-soluble adhesive agent is used, the coating process of the microcapsules may be repeated by more than two times so as to ensure a desired thickness.

The coating of microcapsules is generally required to have a thickness of at least 200 μm. If a particularly small frictional force is desired, a coat's thickness of about 500 μm is preferable.

When the prestressing steel material coated with a layer of these microcapsules is post-tensioned for prestressing purposes, the microcapsules will be ruptured under a small amount of elongation, thereby enabling efficient transmission of the tension to the concrete while ensuring the desired "unbonding" property between the coated prestressing material and the concrete.

Figure 6:
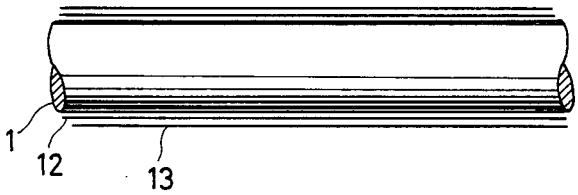
FIG. 6 is a view showing the structure of a coated prestressing steel material in accordance with the another embodiment of the present invention.

The flowable material to be confined in the microcapsules may be selected from oil, grease or synthetic material such as phosphate esters and ethylene glycol. When the microcapsules are ruptured by post-tensioning, these materials will come out and provide a rust-preventing film around the prestressing steel material. If a better rust-inhibiting effect is needed, as shown in FIG. 6, a synthetic resin coat 12 may be applied to the steel member as a corrosion-protective layer prior to coating with the microcapsules.

Samples of coated prestressing steel material were prepared in accordance with the present invention and tested for their unbonding properties. The results are shown in Table 1 below.

TABLE 1

| | Unbonding (Frictional) Properties | | | | |
|---|---|---|---|---|---|
| | Load (Kgf) | | Frictional Loss (Kgf) | Frictional Coefficient $\lambda$ ($m^{-1}$) | |
| Sample No. | Tensioned Side (Pi) | Fixed Side (Po) | | | Remarks |
| 1 | 11,441 | 11,249 | 192 | 0.0070 | Steel rod, 13ϕ |
| 2 | 11,418 | 11,170 | 248 | 0.0091 | Length of concrete section: l = 2,435ppm |
| 3 | 11,423 | 11,237 | 186 | 0.0068 | |
| 4 | 11,405 | 11,180 | 225 | 0.0083 | Sample temperature: T = 25° C. |
| 5 | 11,438 | 11,230 | 208 | 0.0076 | |
| 6 | 11,397 | 11,161 | 236 | 0.0087 | |
| 7 | 11,410 | 11,198 | 212 | 0.0078 | Frictional coefficient: |
| 8 | 11,384 | 11,124 | 260 | 0.0096 | $\lambda = \left(\frac{Pi}{Po} - 1\right) \cdot \frac{1}{l}$ |
| 9 | 11,428 | 11,185 | 243 | 0.0089 | |
| 10 | 11,409 | 11,237 | 172 | 0.0063 | |

Figure 7:
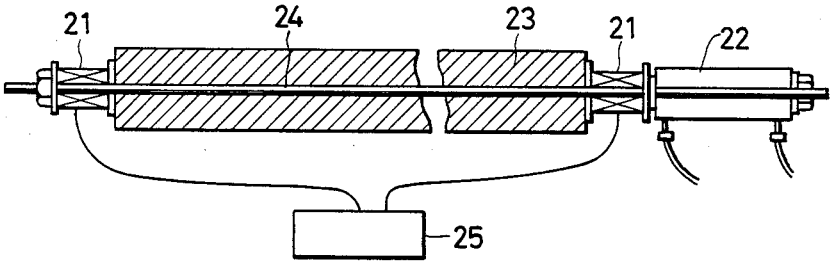
FIG. 7 is a view for explaining the measurement of a frictional coefficient of a prestressing steel material.

The method of measuring the frictional coefficient will be described with reference to FIG. 7.

First, the sample 24 as obtained from the above procedure was placed in concrete 23 and thereafter the concrete was solidified. Load cells 21 were provided at both end portions of the sample member or wire 24 which were exposed from both sides of the concrete 23 and then tension was applied to the sample member 24 by a jack 22 provided at one end of the sample member 24 as shown in FIG. 7. At this time, a load applied to one end of the sample member by using the jack 22 and a load transmitted through the sample member applied to the other end of the sample member, i.e., the fixed side of the sample member, were simultaneously detected through both of the load cells 21 by a load measuring detector 25. Here, if Pi is defined as the load at the application side of the tension using the jack and Po is defined as the load applied to the fixed side of the sample member 24, the friction between the sample member and the concrete is obtained by subtracting Po from Pi and the frictional coefficient λ at unit length of the sample member is obtained from the following equation:

$$\lambda=(Pi-Po)/Po.l=(Pi/Po-1)/l$$

A prestressing steel material having advantages of both the unbonding process and the bonding process is obtained by using microcapsules containing an age-hardening resin or an age-hardening material such as a two-part hardening resin wherein two resins will mix and coalesce together to experience age-hardening, as the flowable material. As one of the two resins, a resin having no volume contraction at the hardening, such as epoxy resin, may be used. As a hardening agent, diethylenetriamine or higher hydrocarbon diamine may be used to harden the epoxy resin at the room temperature.

When the prestressing steel material provided with a surface coating of microcapsules confining the flowable material is post-tensioned, the microcapsules will be disrupted under a fairly small amount of elongation, whereupon the flowable material will come out of each microcapsule to provide the necessary slip properties which allow the steel slide easily within the concrete section. On the other hand, by using an age-hardening material as the flowable material, after the concrete is stressed by post-tensioning, the prestressing steel material is fixed to the concrete to provide a strong integral steel-to-concrete body.

A two-part hardening resin may be used as follows. That is, firstly, microcapsules containing one resin are prepared separately from those containing the other resin. Then, the two types of microcapsules are uniformly mixed in predetermined proportions, and the mixture is applied to or installed on the outer surface of a steel member. When the prestressing steel material is post-tensioned in concrete, the two types of microcapsules are disrupted and the contents thereof react with each other to exhibit hardening and bonding properties, thereby imparting a strong bond between the concrete and the prestressing steel material.

A three-part hardening resin may also be used. The hardening mechanism is not limited to the mixing of two or more contact-hardenable resins. Other hardening mechanism such as hardening by reaction with water, basic hardening or hardening by calcium absorption may also be used. If desired, microcapsules each consisting of two or more compartments incoporating different resins may be used.

As described above, according to the present invention, microcapsules are applied to the surface of a prestressing steel material to provide bonding and/or unbonding property against concrete. The surface of the prestressing steel material applied with the microcapsules may be further coated with a sheath or film of resin material or may be processed to protect it with paper, cloth and the like.

As will be understood from the above description, the prestressing steel material of the present invention is well adapted to use in the fabrication of prestressed concrete in that it ensures high efficiency in unbonding operations and easy handling during service. In addition, this prestressing steel material exhibits highly reliable unbonding properties. Therefore, the prestressing steel material of the present invention will present great benefits to industry.

Further, the prestressing steel material of the present invention has the hitherto inherently conflicting features of the two conventional post-tensioning methods and will therefore prove very useful in the design and fabrication of a prestressed concrete structure.

What is claimed is:

1. A method of prestressing concrete, comprising the following steps:

adhering an outer coat of a plurality of microcapsules, each of said microcapsules containing a flowable material, to an elongate steel member to provide a coated elongate steel member;

placing the coated elongated steel member in concrete such that the microcapsules contact the concrete; and releasing the flowable material in the microcapsules by post tensioning the coated elongate steel member within the concrete.

2. A method according to claim 1, wherein said flowable material is a substance selected from the group consisting of grease and asphalt.

3. A method according to claim 1, wherein each of said microcapsules is formed of a material selected from the group consisting of resin and gelatin that will be disrupted upon application of an external force elongation exceeding a critical value.

4. A method according to claim 1, wherein said flowable material is a hardenable flowable material.

5. A method according to claim 4, wherein the hardenable flowable material is an age-hardening resin.

6. A method according to claim 4, wherein two different hardenable flowable materials are confined in separate microcapsules and will age-harden when they coalesce together.

7. A method according to claim 4, 5 or 6, wherein each of the said microcapsules is formed of a material selected from the group consisting of resin and gelatin that will be disrupted upon application of an external force exceeding a critical value.

8. A method according to claim 4, wherein said microcapsules are coated or installed on the entire outer surface of said steel member.

9. A method according to claim 1, wherein each of said microcapsules has a diameter of 100 to 300 μm.

10. A method according to claim 6, wherein one of such hardenable flowable materials is a epoxy resin and the other is a hardening agent selected from the group consisting of diethylenetriamine and higher hydrocarbon diamine.

11. A method according to claim 1, wherein the thickness of said outer coat is at least 200 μm.

12. A prestressed concrete structure comprising:

a concrete body;

an elongate steel member placed in said concrete body; and an outer coat comprising a plurality of microcapsules which are adhered to the steel member by a suitable adhesive agent and which are in contact with the concrete, said microcapsules containing therein a flowable material, said microcapsules rupturing upon post tensioning to yield said prestressed concrete structure.

13. A prestressed concrete structure according to claim 12, wherein the thickness of said outer coat is at least 200 μm.

14. A prestressed concrete structure according to claim 12, wherein said flowable material is a substance selected from the group consisting of grease and asphalt.

15. A prestressed concrete structure according to claim 12, wherein each of said microcapsules is formed of a material selected from the group consisting of resin and gelatin that will be disrupted upon application of an external force exceeding a critical value.

16. A prestressed concrete structure according to claim 12, wherein each of said microcapsules has a diameter of 100 to 300 μm.

17. A prestressed concrete structure according to claim 12, wherein said microcapsules are coated or installed on the entire outer surface of said steel member.

* * * * *